US008303335B2

(12) United States Patent
Wu et al.

(10) Patent No.: US 8,303,335 B2
(45) Date of Patent: Nov. 6, 2012

(54) CONNECTING MODULE WITH OPTICAL INDICATION

(75) Inventors: Chao-Chung Wu, Taipei (TW); Kuo-Chou Chiu, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 12/854,915

(22) Filed: Aug. 12, 2010

(65) Prior Publication Data

US 2011/0039444 A1 Feb. 17, 2011

Related U.S. Application Data

(60) Provisional application No. 61/233,487, filed on Aug. 12, 2009.

(51) Int. Cl.
*H01R 3/00* (2006.01)

(52) U.S. Cl. ..... 439/490

(58) Field of Classification Search ..... 439/489–490, 439/541.5

See application file for complete search history.

(56) References Cited

U.S. PATENT DOCUMENTS

| | | | | |
|---|---|---|---|---|
| 5,700,157 | A * | 12/1997 | Chung | 439/490 |
| 5,772,466 | A * | 6/1998 | Morin et al. | 439/489 |
| 5,876,240 | A * | 3/1999 | Derstine et al. | 439/490 |
| 5,924,889 | A * | 7/1999 | Wang | 439/490 |
| 5,975,943 | A * | 11/1999 | Chou et al. | 439/490 |
| 6,062,908 | A * | 5/2000 | Jones | 439/620.07 |
| 6,224,417 | B1 * | 5/2001 | Belopolsky et al. | 439/490 |
| 6,409,530 | B1 * | 6/2002 | Zhao et al. | 439/188 |
| 6,431,919 | B1 * | 8/2002 | Wang et al. | 439/680 |
| 6,450,832 | B1 | 9/2002 | Aguilar | |
| 6,511,231 | B2 * | 1/2003 | Lampert et al. | 385/70 |
| 6,594,707 | B1 * | 7/2003 | Rubinstein et al. | 709/250 |
| 6,688,908 | B2 * | 2/2004 | Wallace | 439/490 |
| 6,736,673 | B1 * | 5/2004 | Simmons et al. | 439/541.5 |
| 6,896,542 | B2 * | 5/2005 | Chang | 439/490 |
| 6,921,284 | B2 * | 7/2005 | Sirichai et al. | 439/490 |
| 7,194,183 | B2 * | 3/2007 | Thornton et al. | 385/139 |
| 7,241,157 | B2 * | 7/2007 | Zhuang et al. | 439/188 |
| 7,316,587 | B2 * | 1/2008 | Chien et al. | 439/668 |
| 7,354,298 | B2 * | 4/2008 | James | 439/490 |
| 7,442,056 | B1 * | 10/2008 | Ju | 439/79 |
| 7,497,709 | B1 * | 3/2009 | Zhang | 439/188 |
| 7,556,528 | B1 * | 7/2009 | Ju | 439/541.5 |
| 7,867,017 | B1 * | 1/2011 | Chen | 439/488 |
| 2003/0100218 | A1 * | 5/2003 | Tsai et al. | 439/490 |
| 2004/0147161 | A1 * | 7/2004 | Marshall et al. | 439/490 |
| 2004/0152351 | A1 * | 8/2004 | Hwang et al. | 439/188 |
| 2005/0124220 | A1 * | 6/2005 | Wang | 439/607 |

FOREIGN PATENT DOCUMENTS

CN 101231610 A 7/2008

* cited by examiner

*Primary Examiner* — Briggitte R Hammond
(74) *Attorney, Agent, or Firm* — CKC & Partners Co., Ltd.

(57) ABSTRACT

A connecting module with optical indication for being disposed on an electronic device is disclosed. The connecting module includes multiple first connectors disposed adjacently, and each first connector includes a base, a switch and an optical indicator. The base has an accommodating space, and the switch is disposed at a side wall of the accommodating space. When a second connector is connected to the first connector, a plug of the second connector is inserted into the accommodating space and triggers the switch so as to enable the optical indicator for indicating a connection status of the first connector.

8 Claims, 11 Drawing Sheets

CONNECTING MODULE WITH OPTICAL INDICATION

CROSS REFERENCE TO RELATED APPLICATIONS

This application claims the benefit of U.S. Provisional Application No. 61/233,487, filed on Aug. 12, 2009 and entitled "MOTHERBOARD HAVING DISPLAY DEVICE WITH INDICATION MECHANISM" the contents of which are incorporated herein.

BACKGROUND OF THE INVENTION

1. Field of the Invention

The invention relates to a connecting module disposed on an electronic device and, more particularly, to a connecting module with a optical indication.

2. Description of the Related Art

Nowadays, an electronic device usually has multiple connecting modules to facilitate expansion. In a small system such as a personal computer with connecting modules of the same type, the user may identify the needed connecting modules according to the appearance of the corresponding device. However, if multiple devices with the same type are connected to connecting modules with the same type, and the connecting modules are arranged close to each other, the user may feel confused to identify the correct connecting module or the connecting device.

For example, the motherboard of a server host has eight serial advanced technology attachment (SATA) connecting modules and eight SATA disks, to identify the connecting modules, manufacturers usually print numbers or symbols near the SATA connecting modules on the motherboard or directly on the connectors. When the user needs to operate a certain hard disk, he or she needs to identify the corresponding connecting module and pull the corresponding connector out. Furthermore, whether the connector is pulled out correctly still needs to be confirmed by the server host. Therefore, the whole time is prolonged. Since the server host also has many other electronic components, cables and so on, the available space in the host is rather limited, and the user cannot find and identify the numbers or symbols easily. If the printed numbers or symbols are small, he or she may wrongly identify them, which easily happens in an environment with insufficient light.

BRIEF SUMMARY OF THE INVENTION

The invention discloses a connecting module having a first connector with optical indication. With the function of the optical indication, the user may quickly identify the needed first connector.

The connecting module in the invention is disposed on an electronic device and includes multiple first connectors disposed adjacently, and each first connector includes a base, a switch and an optical indicator. The base includes an accommodating space, and the switch is disposed at a side wall of the accommodating space. When a second connector is connected to the first connector, a plug of the second connector is inserted in the accommodating space and triggers the switch so as to enable the optical indicator for indicating the connection status of the first connector.

Consequently, when connectors are connected to the first connectors, the electronic device may control the optical indicator to light functionally to guide the user to operate the correct first connector. Therefore, the user can find and operate the first connector correctly and quickly. Compared with the conventional technology, in the invention, even if the first connectors are disposed adjacently, the available space of the casing is limited, and the light in the environment is insufficient, the user still can find and identify the symbol easily with the optical indication of the electronic device, and he or she may identify the first connectors easily without misoperating the first connector.

These and other features, aspects and advantages of the present invention will become better understood with regard to the following description, appended claims, and accompanying drawings.

DETAILED DESCRIPTION OF THE EMBODIMENTS

Figure 1:
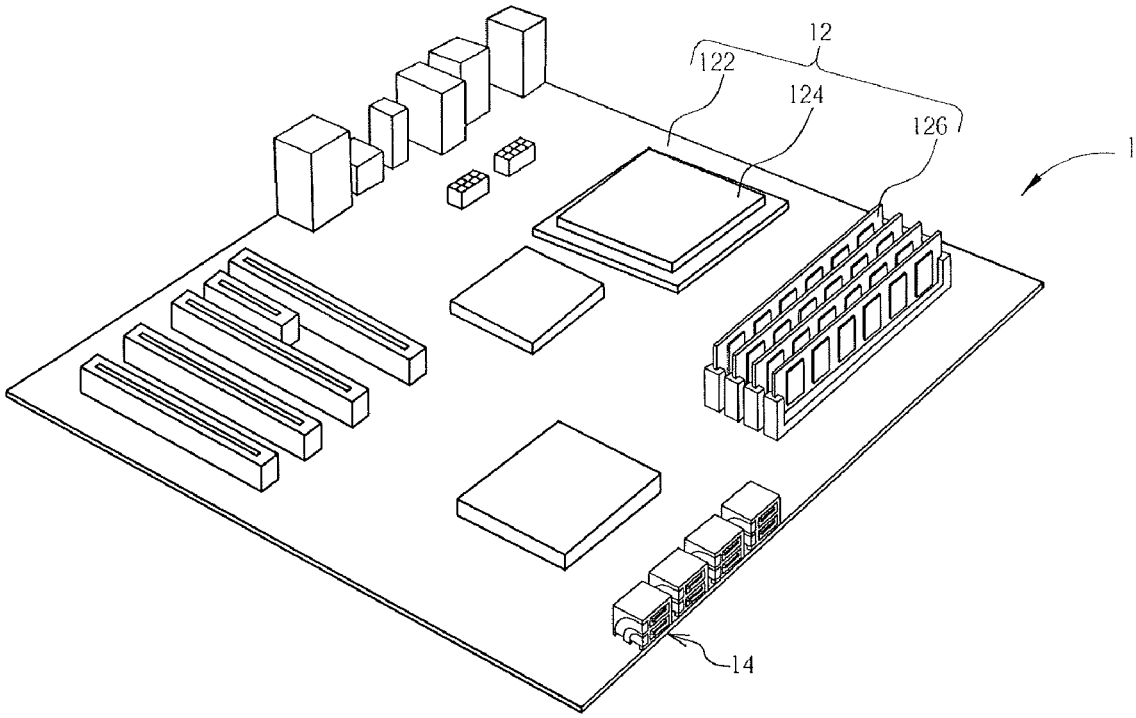
FIG. 1 is a schematic diagram showing an electronic device in a first embodiment of the invention.
Figure 2:
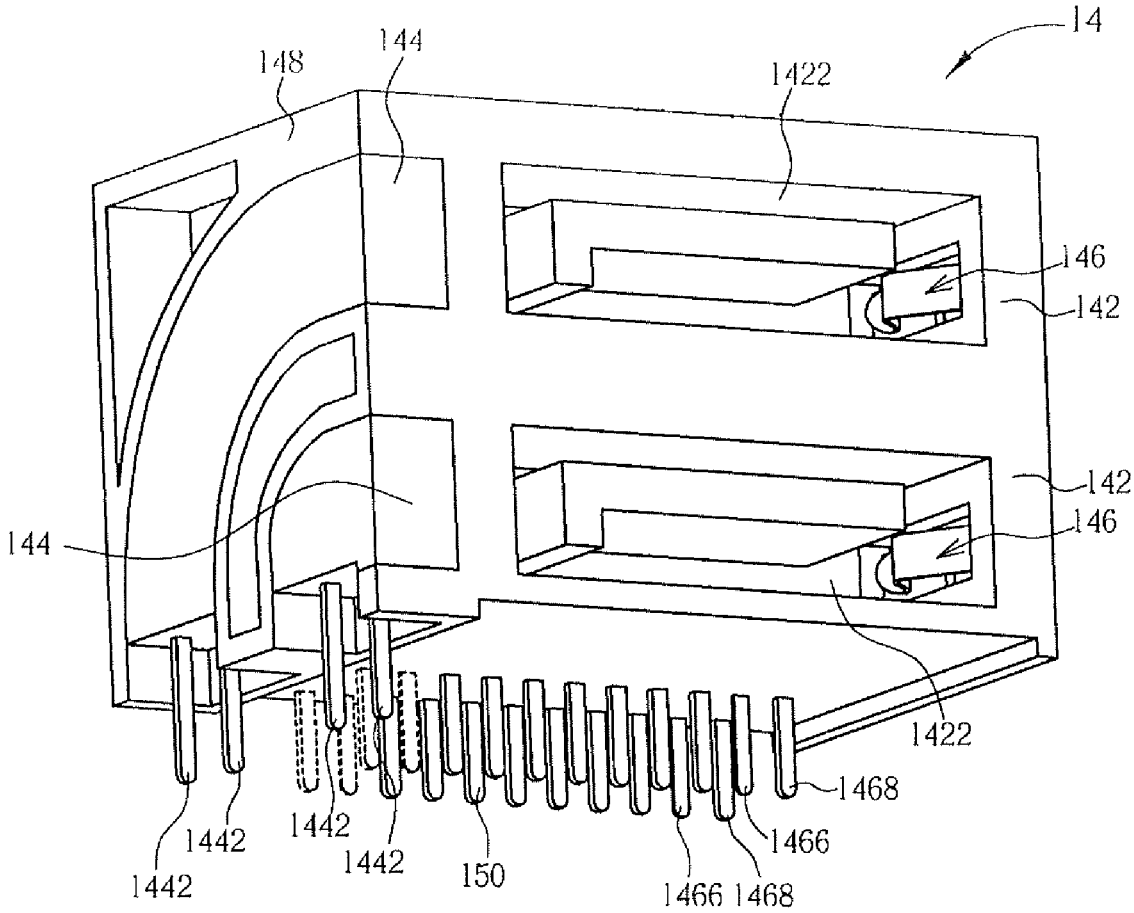
FIG. 2 is a three-dimensional diagram showing a connecting module in a first embodiment of the invention.
Figure 3:
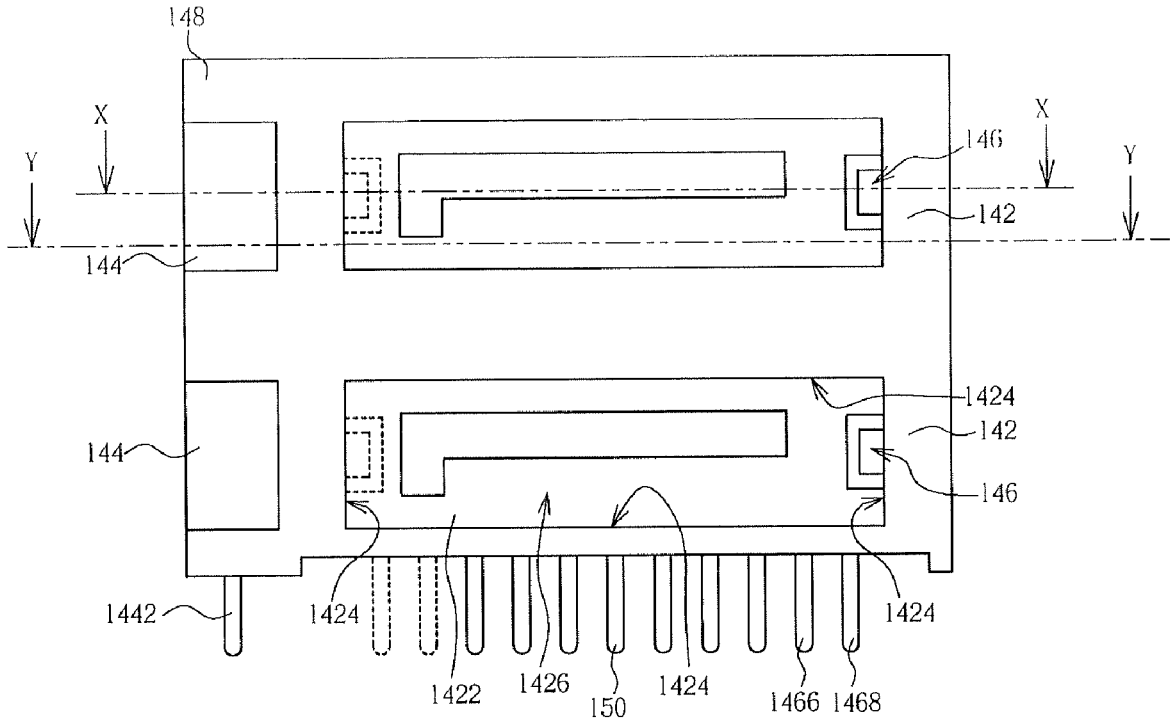
FIG. 3 is the front view diagram showing the connecting module in FIG. 2.
Figure 4:
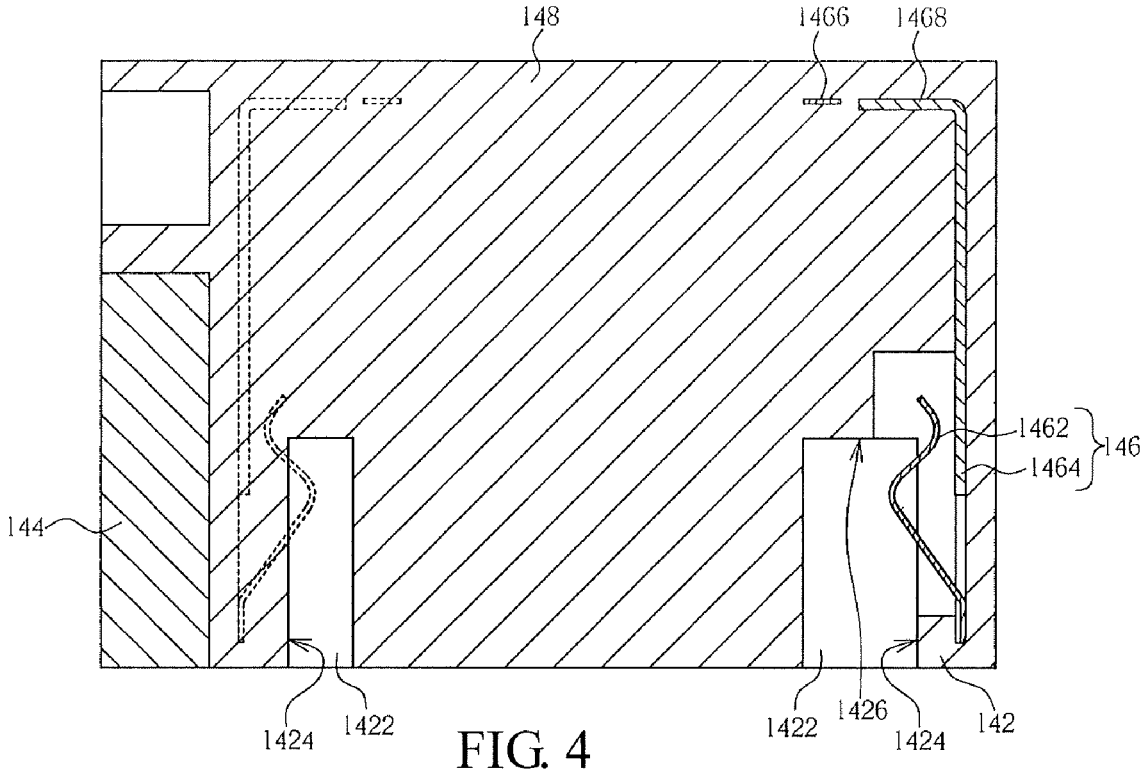
FIG. 4 is a sectional diagram showing the connecting module in FIG. 2 taken along line X-X.

FIG. 1 is a schematic diagram showing an electronic device 1 in a first embodiment of the invention. The electronic device 1 includes a processing module 12 and four connecting modules 14 electrically connected to the processing module 12. The processing module 12 includes a motherboard 122 and the elements on the motherboard such as a processor 124 and a memory 126. The connecting modules 14 are disposed on a motherboard 122 directly. In the embodiment, the connecting modules 14 are integrated connectors at the edge of the motherboard, and the invention is not limited thereto. The connecting modules 14 are disposed adjacently, and each connecting module 14 includes two first connectors piled with each other. Therefore, the electronic device 1 includes eight adjacent first connectors, FIG. 2 is a three-dimensional diagram showing the connecting modules 14. FIG. 3 is a front view diagram showing the connecting module 14 in FIG. 2. FIG. 4 is a sectional diagram showing the connecting module 14 in FIG. 2 taken along line X-X. To show the structure of the connecting modules 14 simply, the pins of the first connector and other detailed structures are not shown for a concise purpose (they are also omitted in the following figures). Each first connector includes a base 142, an optical indicator 144 and a switch 146. The base 142 includes an accommodating space 1422, and the switch 146 is disposed at a side wall of the accommodating space 1422. In the embodiment, the connecting module 14 includes a housing 148 integrally formed with the two bases 142, but the invention is not limited thereto. In practical usage, the connecting module 14 also may have multiple independent first connectors assembled together. In addition, the first connector is a SATA port, the optical indicators 144 are light-emitting diodes (LED), and the invention is not limited thereto. In the embodiment the first connector also may be a USB port, a 1394 port, an E-SATA port and so on.

Figure 5:
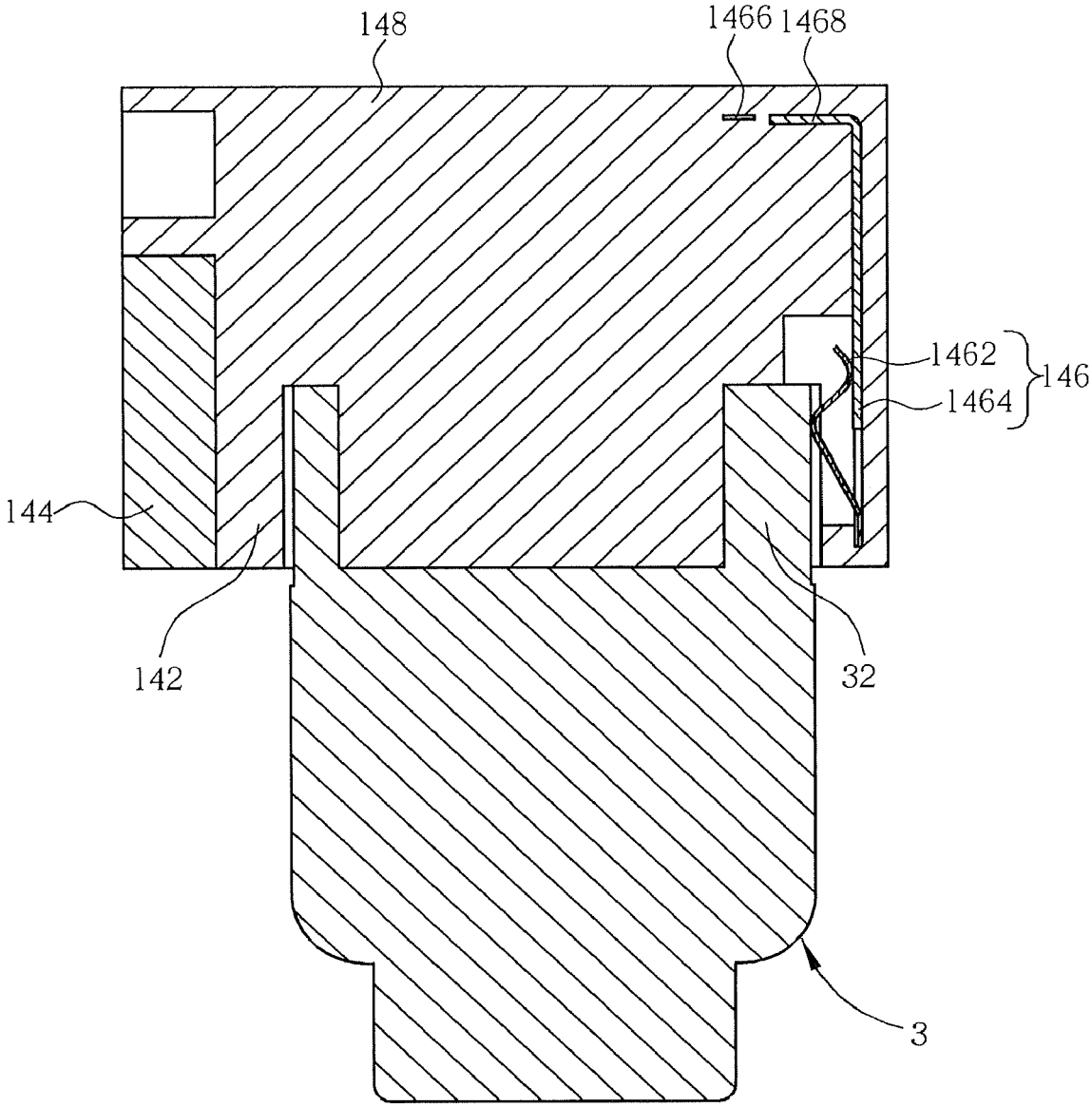
FIG. 5 is a sectional diagram showing that a second connector is inserted into the first connector in a first embodiment of the invention.

In the embodiment, an accommodating space 1422 of the base 142 is formed mainly by four side walls 1424 and a bottom wall 1426 for accommodating a connector. The switch 146 is a mechanical switch including an elastic portion 1462 and a contacting portion 1464, and the elastic portion 1462 extends into the accommodating space 1422 from the right side wall 1424 of the side walls. FIG. 5 is a sectional diagram showing that a second connector 3 is inserted into the first connector. As shown in FIG. 5, after the plug 32 of the second connector 3 is inserted into the accommodating space 1422, the side wall of the plug 32 of the second connector 3 presses the elastic portion 1462 to contact the contacting portion 1464, and then the switch 146 is conducted. In addition, although the switch in the embodiment is a mechanical switch with an elastic portion, the invention is not limited thereto. In practical usage, if the switch can be triggered by the plug 32 inserted in the accommodating space 1422 to enable the corresponding optical indicator 144, other mechanical switches or non-mechanical switches also may be used. In the embodiment, the optical indicator 144 is enabled when the switch is conducted. Moreover, the optical indicator 144 also may be enabled when the switch is off. For example, before the switch 146 is off, the optical indicator 144 is short circuited, and after the switch 146 is off, there is a voltage difference across the corresponding optical indicator 144.

Figure 6:
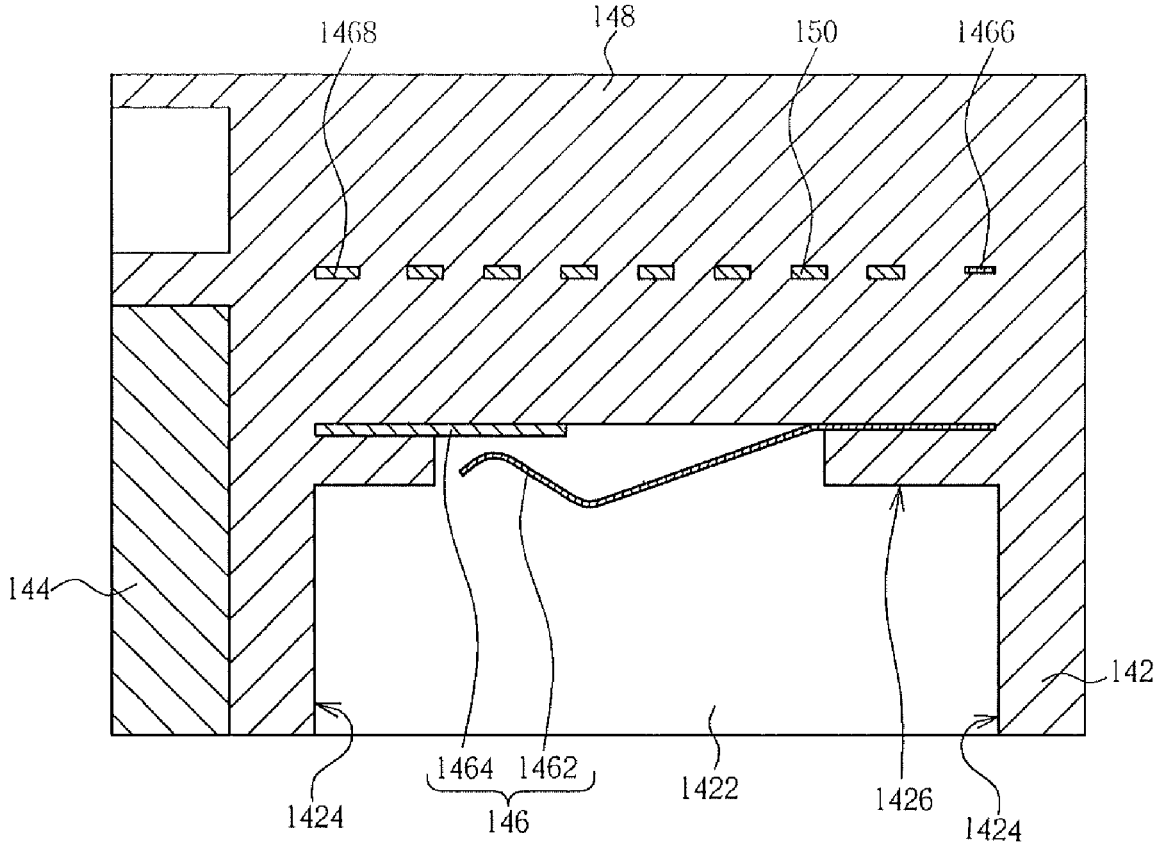
FIG. 6 is a sectional diagram showing the connecting module in a second embodiment of the invention.

In the embodiment of the invention, the switch 146 is disposed at the right side of the accommodating space 1422, but the invention is not limited thereto. For example, the switch 146 also may be disposed at the left side of the accommodating space 1422, and similarly, the elastic portion 1462 extends from the left side wall 1424 to the accommodating space 1422, which is shown as the dashed line in FIG. 3 and FIG. 4. As shown in FIG. 6, it is a sectional diagram showing the connecting module 14 taken along a line whose position is the same as the line Y-Y in FIG. 3 in a second embodiment of the invention. In FIG. 6, the switch 146 is disposed at the bottom wall 1425 of the accommodating space 1422, and the elastic portion 1462 extends from the bottom wall 1426 to the accommodating space 1422. Similarly, after the plug 32 is inserted into the accommodating space 1422, the front portion of the plug 32 presses the elastic portion 1462 to contact the contacting portion 1464, and the switch 146 is also conducted. Similarly, in practical usage, the switch 146 also may be disposed at the upper side wall 1424 or the lower side wall 1424, which is not illustrated again for a concise purpose.

Figure 7:
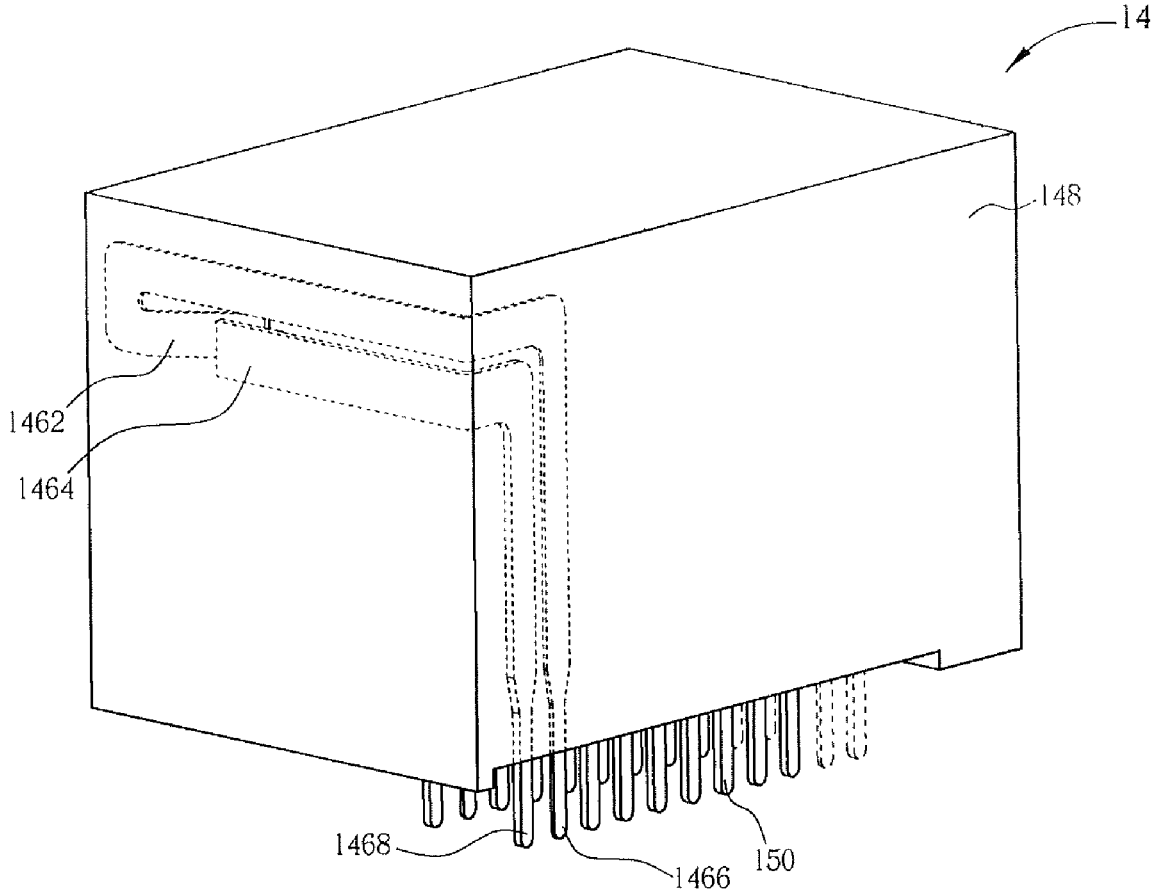
FIG. 7 is the three-dimensional diagram showing the connecting module in FIG. 2 in another viewing aspect.

As shown in FIG. 2 to FIG. 4, the optical indicators 144 are disposed adjacent to the openings of the accommodating space 1422, respectively, and thus the user can quickly identify the needed first connector. In the embodiment, the transmission pins 150 of the first connector (only one first connector is shown), the power pin 1442 of the optical indicator 144 and the pins 1466 and 1468 of the switch 146 are independent in the housing 148, and especially, the pins of the optical indicator 144 and the pins of the switch 146 are not connected to each other until they are electrically connected to the motherboard 122. Consequently, the pins of the connecting module 14 that is connected to the motherboard 122 is more than that of the conventional connecting modules. However, the cost for manufacturing the connecting module 14 is greatly reduced, and the reliability is increased. The connections between the pins of the elastic portion 1462 and the contacting portion 1464 may be referred to FIG. 7, which is a three-dimensional diagram showing the connecting module 14 in another viewing aspect. The hidden part of the switch 146 is shown in dashed line. In addition, the dashed line part in FIG. 2 to FIG. 4 shows the switch 146 disposed at the left side wall 1424 and the positions of the pins. In FIG. 6, since the switch 146 is located at the bottom wall 1426, the pins 1466 and 1468 may be directly positioned at the left and right sides of the transmission pin 150 of the first connector (as shown in FIG. 6).

Figure 8:
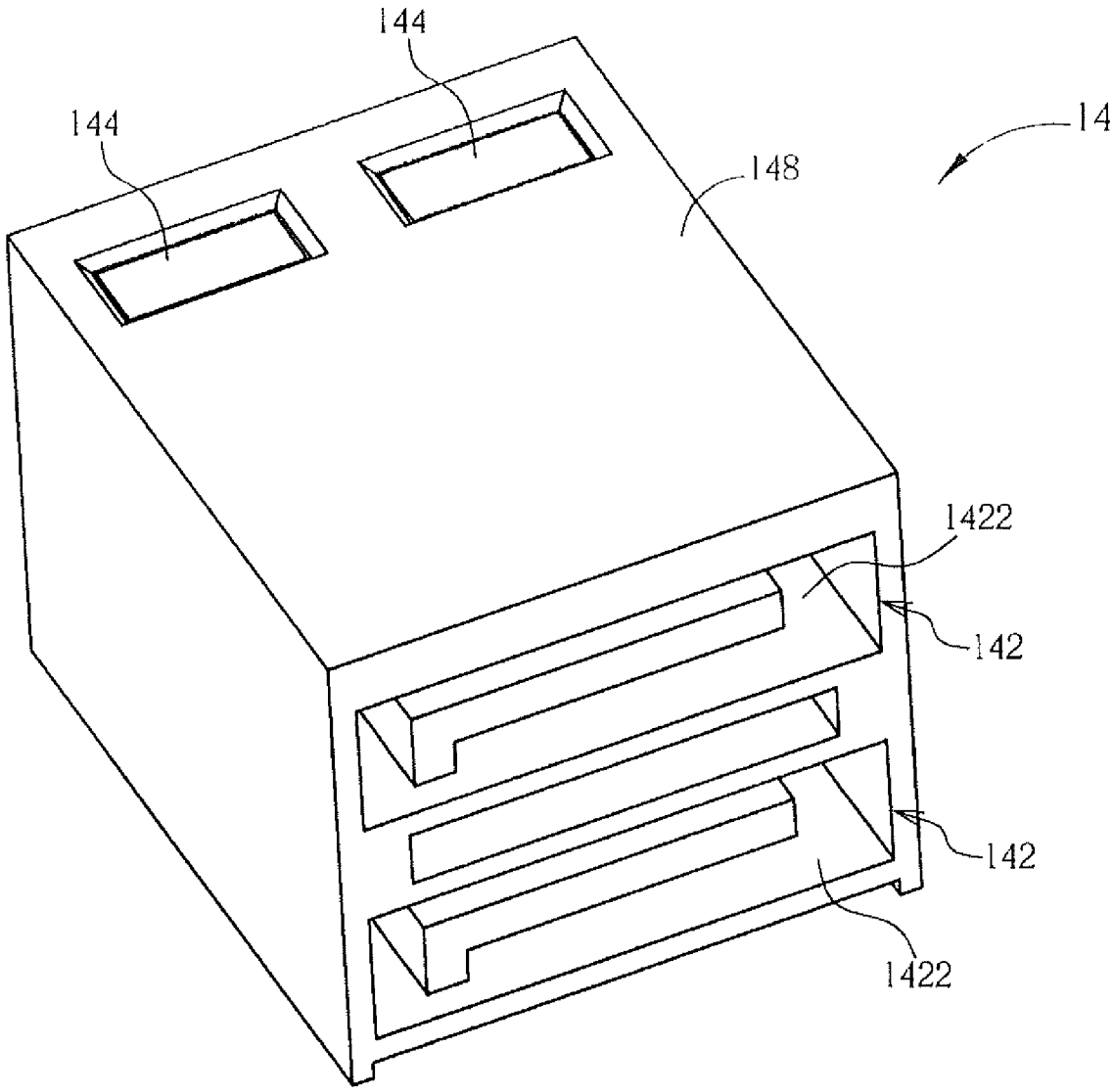
FIG. 8 is a three-dimensional diagram showing the connecting module according to a third embodiment of the invention.
Figure 9:
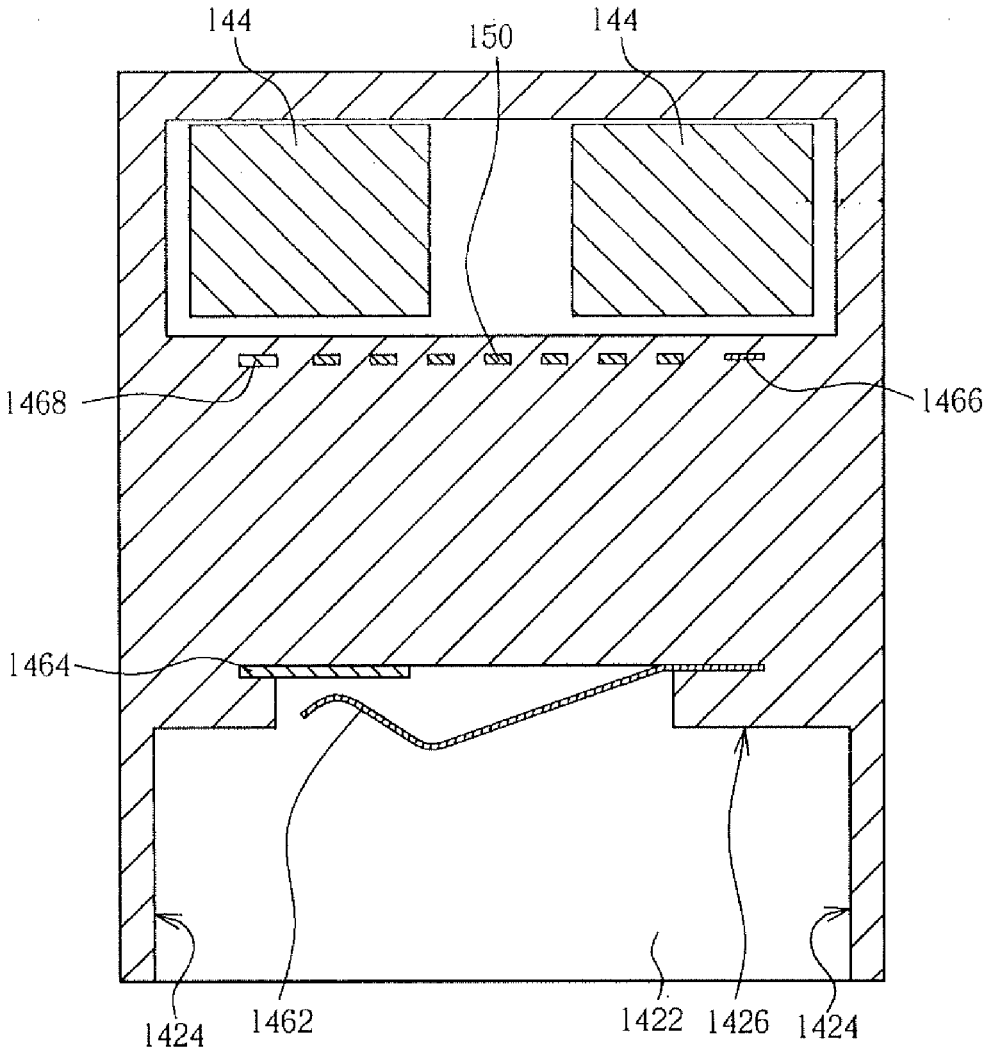
FIG. 9 is a sectional diagram showing the first connector in FIG. 8.

In the above embodiment, the optical indicator 144 directly disposed adjacent to the first connector (near the opening of the accommodating space 1422) can directly indicate the needed first connector. To the sequentially arranged first connectors, if the corresponding optical indicators are also disposed sequentially, the user also may get the position of the needed connecting module according to the position of the optical indicator. As shown in FIG. 8 and FIG. 9, FIG. 8 is a three-dimensional diagram showing a connecting module 14 according to a third embodiment of the invention, and FIG. 9 is a sectional diagram showing the first connector taken along a line whose position is the same as the line Y-Y in FIG. 3. The difference between FIG. 9 and FIG. 2 is that the optical indicators 144 are arranged on the housing 148 adjacently, and preferably located at the top wall of the housing 148 to allow the user to identify quickly. In addition, in the embodiment, the elastic portion 1462 of the switch 146 extends to the accommodating space 1422 from the bottom wall 1426, which is not limited in the invention. The position of the switch 146 and other related illustration are similar to that in the above embodiments, which are not illustrated again for a concise purpose.

Figure 10:
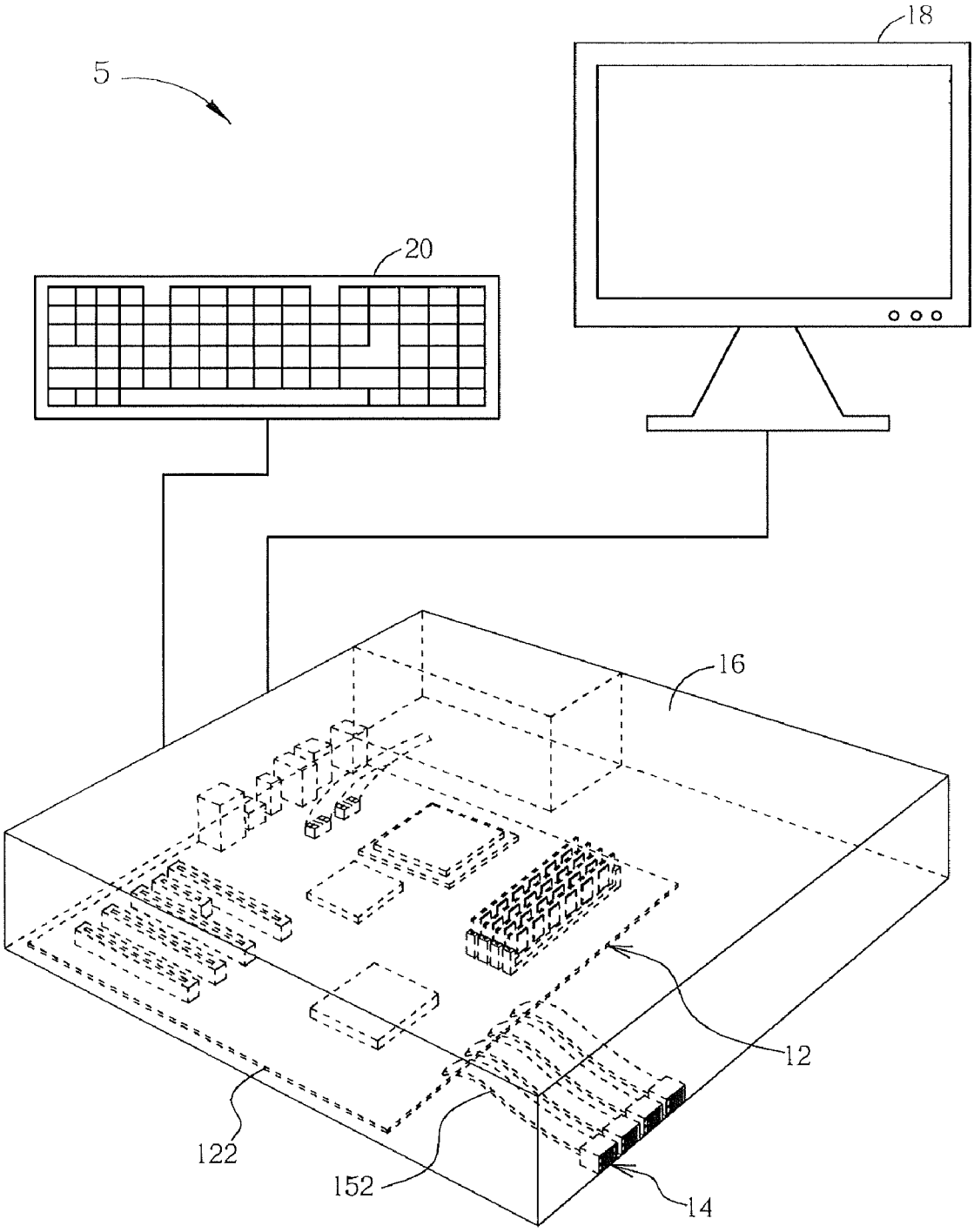
FIG. 10 is a schematic diagram showing the electronic device in a second embodiment of the invention.

FIG. 10 is a schematic diagram showing the electronic device 5 in a second embodiment of the invention. As shown in FIG. 2 to FIG. 10, the difference between the electronic device 1 and the electronic device 5 is that the electronic device 5 further includes a casing 16, a screen 18 and a keyboard 20. The processing module 12 is disposed inside the casing 16, and the connecting module 14 is electrically connected to the processing module 12 via a cable 152. The first connector 16 is exposed from the casing 16 to facilitate the operation, and each cable 152 may be integrated into a single cable to facilitate collection. If only one surface of the connecting module 14 is exposed, the optical indicator 144 is preferably disposed near the accommodating space 1422 of the first connector. In addition, if the motherboard 122, the connecting module 14 and the casing 16 are disposed properly, the connecting module 14 which is directly fixed to the motherboard 122 also may be exposed from the casing 16, and the cable 152 does not need to be additionally disposed. In addition, other illustration about the electronic device 5 may be referred to the above embodiments and the figures, which is not illustrated again for a concise purpose.

In the embodiments above, when a second connector is inserted into one of the first connectors, the corresponding switch 146 is triggered to enable the corresponding optical indicator 144, and the processing module 12 may control the optical indicator 144 to light functionally. For example, if the optical indicator lights continuously, it indicates that the corresponding first connector operates normally, and if the optical indicator flashes, it indicates that the first connector has improper connections. The different shining modes may be set and processed cooperating with the applications, and the user may change the settings via the screen 18 and the keyboard 20 (or other input devices) to manage the connecting device such as the redundant arrays of independent disks (RAID) or other connecting device (such as the USB interface). In addition, the switch 146 may be connected in series with the optical indicator 144 to enable the optical indicator directly. In practical usage, the switch also may be independent from the circuit of the optical indicator 144, a processing module 12 detects the connection of the first connector, and the optical indicator 144 is controlled additionally. Thus, when the optical indicator 144 in FIG. 10 is damaged, it is more easily to identify that whether the optical indicator 144 is damaged or the switch is not conducted.

Figure 11:
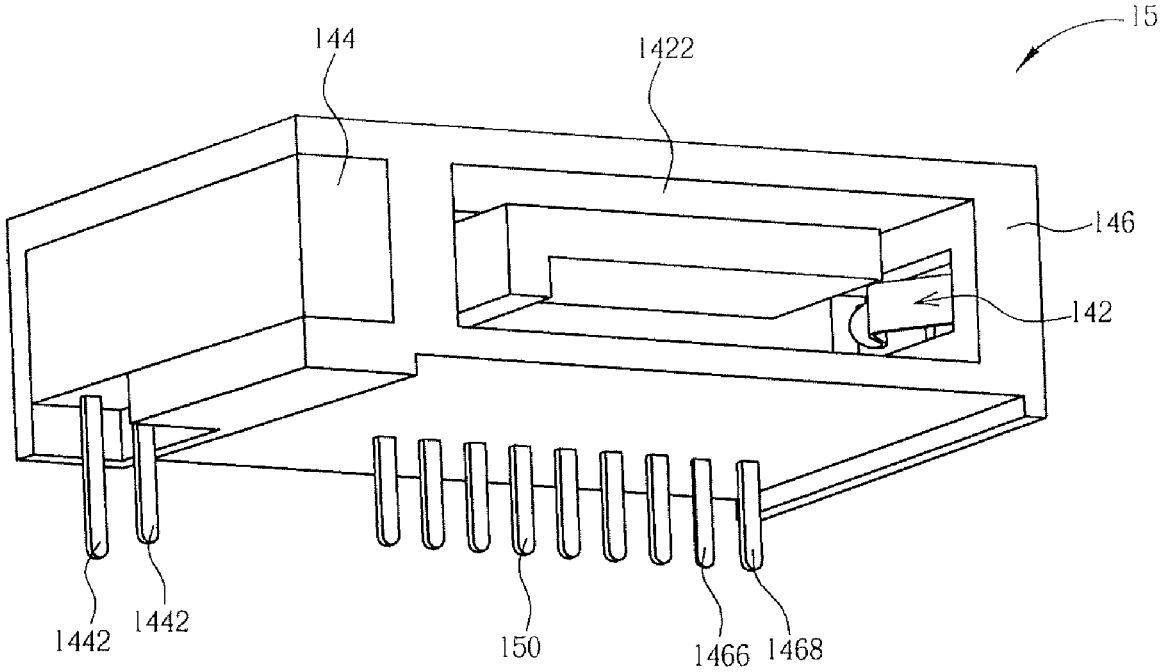
FIG. 11 is a schematic diagram showing the connecting module in the fourth embodiment of the invention.

In the above embodiments, multiple connectors are integrated in a housing, but the invention is not limited thereto. FIG. 11 is a schematic diagram showing the connecting module 15 in the fourth embodiment of the invention. As shown in FIG. 2 and FIG. 11, the difference between the connecting module 14 and the connecting module 15 is that the connecting module 15 only includes one first connector, and the manufacturer only needs to consider the position for disposing the pins of the first connector, and the manufacturing difficulty is reduced. In practical usage, the multiple connecting modules are usually disposed adjacently, and the function of the optical indicator 144 of the connecting module 15 is the same as that of the above optical indicators 144 of the connecting modules 14. The illustration about the first connectors of the connecting modules 14 in the above embodiments is also adapted to the connecting module 15, and it is not illustrated for concise purpose.

Conventionally, the user usually spends effort to look for and identify the small symbols on the motherboard or the connector. However, the symbols also easily wrongly identified, and he or she still needs to look for the symbols until the symbols are correctly identified, which costs too much time and manpower. In the electronic device of the invention, even if the first connecting modules of the connecting module are adjacent to each other, the available space in the casing is limited, and the environment light may be insufficient, the user still can get the position of the needed connecting module by controlling the optical indicator to light functionally. Therefore, the user does not need to spend much effort to find and identify the symbol, and he or she may easily identify the needed first connector.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

What is claimed is:

1. A connecting module disposed on an electronic device, the connecting module comprising:

an integrally-formed housing:

multiple first connectors disposed closely within the integrally formed housing, wherein each of the first connectors includes:

a base including an accommodating space; and a switch disposed at a side wall of the accommodating space, wherein the switch comprising an elastic portion and a contacting portion, the elastic portion extends into the accommodating space; and multiple optical indicators disposed on an outer surface of the integrally-formed housing, each optical indicator is connected with the corresponding switch;

when a second connector is connected to one of the multiple first connectors, a plug of the second connector is inserted into the corresponding accommodating space and the plug presses the corresponding elastic portion to contact the corresponding contacting portion to trigger the corresponding switch to enable the corresponding optical indicator to indicate a connection status of the corresponding first connector.

2. The connecting module according to claim 1, wherein the base comprises four side walls and a bottom wall to form the accommodating space, and the elastic portion extends to the accommodating space from one of the side walls or the bottom wall.

3. The connecting module according to claim 1, wherein each optical indicator is disposed at a lateral outer surface of the integrally-formed housing and adjacent to an opening of the corresponding accommodating space.

4. The connecting module according to claim 1, wherein each optical indicator is disposed at a top outer surface of the integrally-formed housing.

5. The connecting module according to claim 1, wherein the first SATA connectors are piled with each other.

6. The connecting module according to claim 1, wherein the electronic device comprises a motherboard, and the connecting module is disposed on the motherboard.

7. The connecting module according to claim 6, wherein the first connector comprises multiple transmission pins and multiple pins connected to the optical indicator and the switch.

8. The connecting module according to claim 6, wherein the electronic device comprises a casing, and the motherboard is disposed inside the casing, the connecting module is electrically connected to the motherboard via a cable, and the first connectors are exposed from the casing.

* * * * *